US011623328B2

(12) United States Patent
Dietiker et al.

(10) Patent No.: US 11,623,328 B2
(45) Date of Patent: Apr. 11, 2023

(54) MULTI-PUMP HAND TOOL

(71) Applicant: Oetiker Tool Corporation, Branford, CT (US)

(72) Inventors: Daniel Myers Dietiker, Oxford, MI (US); Scott Wetzel, Milford, CT (US)

(73) Assignee: Oetiker Tool Corporation, Branford, CT (US)

( * ) Notice: Subject to any disclaimer, the term of this patent is extended or adjusted under 35 U.S.C. 154(b) by 0 days.

(21) Appl. No.: 17/454,397

(22) Filed: Nov. 10, 2021

(65) Prior Publication Data

US 2022/0161401 A1 May 26, 2022

Related U.S. Application Data

(60) Provisional application No. 63/118,269, filed on Nov. 25, 2020.

(51) Int. Cl.
*B25B 27/10* (2006.01)
*B21D 39/04* (2006.01)

(52) U.S. Cl.
CPC ..... *B25B 27/10* (2013.01); *B21D 39/046* (2013.01)

(58) Field of Classification Search
CPC .. B25B 7/12; B25B 7/112; B25B 7/06; B25B 7/20; B25B 27/146
USPC ..... 81/361, 383.5, 384
See application file for complete search history.

(56) References Cited

U.S. PATENT DOCUMENTS 1,140,200 A * 5/1915 Smith ..... B25B 7/12 81/314
1,507,974 A * 9/1924 Northup ..... B25B 23/00 81/62
1,784,213 A * 12/1930 Westphal ..... B65B 13/345 140/153
2,762,414 A * 9/1956 Demler ..... H01R 43/033 72/448
2,861,488 A * 11/1958 Barnes ..... H01R 43/042 72/409.1
2,898,790 A * 8/1959 Lazar ..... H01R 43/042 81/60
3,040,606 A * 6/1962 Ericsson ..... B65B 13/345 81/313
3,089,366 A * 5/1963 Haraden ..... B65B 13/345 81/313
3,101,017 A * 8/1963 Buchalter ..... H01R 43/042 72/409.1

(Continued)

*Primary Examiner* — Jason L Vaughan
(74) *Attorney, Agent, or Firm* — McCarter & English, LLP; Dave S. Christensen

(57) ABSTRACT

A tool and method of operating the tool is provided. The tool includes a first jaw, the first jaw arranged to rotate about a first pivot. A second jaw is arranged adjacent the first jaw, the second jaw arranged to rotate about a second pivot. A first cam member is rotatable about an axis, the first cam member being operably coupled to second jaw. A second cam member is rotatable about the axis, the second cam member being operable coupled to the first jaw. At least one movable handle is operably coupled to the first cam member and the second cam member. A clutch is operably coupled to the first cam member and the second cam member, the clutch being configured to allow free-rotation in first direction about the axis and prevent rotation in an opposite second direction.

20 Claims, 14 Drawing Sheets

(56) References Cited

U.S. PATENT DOCUMENTS 3,126,775 A * 3/1964 Ramge ..... B25B 7/12 81/349
3,210,844 A * 10/1965 Tontscheff ..... B23D 29/023 81/358
3,324,702 A * 6/1967 Malkin ..... H01R 43/042 72/409.1
4,221,048 A * 9/1980 Parramore ..... H01R 43/042 30/189
4,266,419 A * 5/1981 Grundfest ..... H01R 43/042 72/409.1
4,433,569 A * 2/1984 Santinelli ..... B25B 7/12 72/409.1
4,742,737 A * 5/1988 Hatfield ..... H01R 43/042 81/355
4,809,571 A * 3/1989 Hatfield ..... H01R 43/042 81/355
4,884,432 A * 12/1989 Watson ..... B25B 25/005 72/409.13
5,074,142 A * 12/1991 Heskey ..... B25B 27/10 72/409.1
5,410,903 A * 5/1995 Schneider ..... B25B 25/005 72/399
6,138,346 A * 10/2000 Shutts ..... H01R 43/0428 29/761
6,948,234 B1 9/2005 Steiner
7,434,440 B2 * 10/2008 Fay ..... B25B 7/12 29/243.517
8,015,853 B2 9/2011 Steiner et al.
8,245,560 B2 * 8/2012 Battenfeld ..... B25B 27/10 72/409.16
8,286,461 B2 * 10/2012 Hofmann ..... B25B 27/10 81/348
8,312,755 B1 11/2012 Steiner et al.
9,808,851 B2 * 11/2017 Thorson ..... F16H 25/20
10,953,527 B2 * 3/2021 Wetzel ..... B25B 7/123
2003/0167881 A1 * 9/2003 Chauffeteau ..... B25B 25/005 81/9.3
2014/0009636 A1 1/2014 Lee et al.
2014/0165353 A1 6/2014 Steiner et al.
2019/0240821 A1 8/2019 Wetzel et al.
2020/0078912 A1 3/2020 Roberts et al.

* cited by examiner

MULTI-PUMP HAND TOOL

CROSS REFERENCE TO RELATED APPLICATIONS

This application claims the benefit of U.S. Provisional Application Ser. No. 63/118,269, filed Nov. 25, 2020, the entire disclosure of which is incorporated herein by reference.

BACKGROUND

The subject matter disclosed herein relates to a hand tool, and in particular to a hand tool having a pair jaws that are moved from an open to a closed position, such as for crimping clamps used in connecting fittings to tubing.

In a number of different applications, objects, fittings, or clamps may be crimped to provide a secure connection. The process of crimping involves deforming one or more pieces of material, sometimes past its elastic limit, to secure the material and prevent unintended loosening of the parts or clamp. For example, two pieces of sheet metal may be coupled together by overlapping the sheet metal and deforming one or both pieces into contact with each other. As another example, one type of clamp is a stainless steel band clamp that is formed in a shape of a ring. These band clamps may be used in a variety of applications, such as but not limited to automotive and irrigation systems for example. The ring is slid over and surrounds the tubing and fitting. The clamp is then crimped to reduce the diameter of the band and secure the tubing, such as to a fitting or another tube for example A tool is often used to form a crimp. It should be appreciated that considerable force is used in the forming of a crimp and the tool provides the mechanical advantage to allow the operator to deform the material. Typical tools perform the crimp with a single actuation of the tool. In many instances this causes the tool to have longer than desired handles in order to obtain a desired mechanical advantage.

Accordingly, while existing tools are suitable for their intended purposes, the need for improvement remains, particularly in providing a multi-pump hand tool that includes the features and advantages described herein.

BRIEF DESCRIPTION

In accordance with one aspect of the present disclosure a tool is provided. The tool includes a first jaw, the first jaw arranged to rotate about a first pivot. A second jaw is arranged adjacent the first jaw, the second jaw arranged to rotate about a second pivot. A first cam member is rotatable about an axis, the first cam member being operably coupled to second jaw. A second cam member is rotatable about the axis, the second cam member being operable coupled to the first jaw. At least one movable handle is operably coupled to the first cam member and the second cam member. A clutch is operably coupled to the first cam member and the second cam member, the clutch being configured to allow free-rotation in first direction about the axis and prevent rotation in an opposite second direction.

In addition to one or more of the features described herein, or as an alternative, further embodiments of the tool may include the first jaw having a first follower surface, the second jaw having a second follower surface, and the first cam member having a first cam surface. The first cam surface engages the second follower surface to rotate the second jaw from an open position to a closed position. The second cam member has a second cam surface, the second cam surface engaging the first follower surface to rotate the first jaw from the open position to the close position.

In addition to one or more of the features described herein, or as an alternative, further embodiments of the tool may include the first cam member further having a first reset surface disposed between a first end and a second end of the first cam surface, the second follower surface moving over the first reset surface to move the second jaw from the closed to the open position in response to further rotation of the first cam member when the jaws are in the closed position. The second cam member further having a second reset surface disposed between a first end and a second end of the second cam surface, the first follower surface moving over the second reset surface to move the first jaw from the closed to the open position in response to further rotation of the second cam member when the jaws are in the closed position.

In addition to one or more of the features described herein, or as an alternative, further embodiments of the tool may include a biasing member coupled between the first jaw and the second jaw, the biasing member biasing the first jaw and the second jaw towards the open position. In addition to one or more of the features described herein, or as an alternative, further embodiments of the tool may include the biasing member being a compression spring.

In addition to one or more of the features described herein, or as an alternative, further embodiments of the tool may include a cam handle operably coupled to rotate the first cam member and the second cam member in the first direction to advance the position of the first jaw and second jaw from the open position towards the closed position.

In addition to one or more of the features described herein, or as an alternative, further embodiments of the tool may include the first jaw has a first jaw portion and the second jaw has a second jaw portion, the first jaw portion and second jaw portion cooperating to crimp an object in response to a movement of the at least one movable handle. In addition to one or more of the features described herein, or as an alternative, further embodiments of the tool may include the first jaw having an indicator surface on an end of the of the first jaw opposite the first jaw portion.

In accordance with another aspect of the disclosure another tool is provided. The tool includes a first jaw arranged to rotate about a first pivot between an open position and a closed position, the first jaw having a first jaw portion on a first end and a first follower on a second end. A second jaw is arranged to rotate about a second pivot between the open position and the closed position, the second jaw having a second jaw portion on a first end a and a second follower on a second end. A cam assembly is arranged to rotate about an axis, the cam assembly being operably coupled to the first follower and the second follower to move the first aw and the second jaw from the open position to the closed position in response to a rotation of the cam assembly. A clutch is operably coupled to the cam assembly to allow rotation in a single directory.

In addition to one or more of the features described herein, or as an alternative, further embodiments of the tool may include the cam assembly having: a first shaft operably coupled to the clutch; a first cam member operably coupled between the shaft and the second follower; and a second cam member operably coupled between the shaft and the first follower.

In addition to one or more of the features described herein, or as an alternative, further embodiments of the tool may include a cam handle operably coupled to the first shaft opposite the cam assembly. In addition to one or more of the features described herein, or as an alternative, further embodiments of the tool may include a movable handle operably coupled to the cam assembly; and a stationary handle operably coupled to the first pivot and the second pivot. In addition to one or more of the features described herein, or as an alternative, further embodiments of the tool may include a biasing member coupled between the first jaw and the second jaw, the biasing member being disposed between the first pivot and the first jaw portion.

In addition to one or more of the features described herein, or as an alternative, further embodiments of the tool may include the cam assembly further having a first disk member coupled to the first cam member and a second disk member coupled to the second cam member, the second disk member being arranged between the second cam member and the clutch. In addition to one or more of the features described herein, or as an alternative, further embodiments of the tool may include the first cam member extending from the first disk member and the second cam member extends from the second disk member. In addition to one or more of the features described herein, or as an alternative, further embodiments of the tool may include the first cam member being integrally formed with the first disk member and the second cam member is integrally formed with the second disk member.

In accordance with another aspect of the disclosure a method of crimping an object is provided. The method includes moving a handle and rotating a cam assembly in a first direction in response to movement of the handle, the cam assembly having a first cam surface engaged with a first follower of a first jaw and a second cam surface engaged with a second follower of a second jaw. Rotation in a second direction is prevented with a clutch, the clutch being operably coupled to the cam assembly, the second direction being opposite the first direction. The first jaw and the second jaw are rotated from an open position to a closed position to crimp the object in response to rotation of the cam assembly.

In addition to one or more of the features described herein, or as an alternative, further embodiments of the method may include advancing the movement of the first jaw and the second jaw from the open position to the closed position in response to movement of a cam handle, the cam handle being operably coupled to the cam assembly.

In addition to one or more of the features described herein, or as an alternative, further embodiments of the method may include displaying an indicating surface when the first jaw and the second jaw are in the closed position, the indicating surface being disposed on an end of the one of the first jaw and the second jaw.

In addition to one or more of the features described herein, or as an alternative, further embodiments of the method may include moving the first jaw and the second jaw from the closed position to the open position in response to further movement of the handle after the first jaw and the second jaw are in the closed position.

These and other advantages and features will become more apparent from the following description taken in conjunction with the drawings.

BRIEF DESCRIPTION OF DRAWINGS

The subject matter, which is regarded as the disclosure, is particularly pointed out and distinctly claimed in the claims at the conclusion of the specification. The foregoing and other features, and advantages of the disclosure are apparent from the following detailed description taken in conjunction with the accompanying drawings in which:

The detailed description explains embodiments of the disclosure, together with advantages and features, by way of example with reference to the drawings.

DETAILED DESCRIPTION

Embodiments disclosed herein provide for a crimping tool for forming a crimp on an object. Embodiments of the crimping tool provide advantages in a compact tool for crimping objects. Embodiments of the crimping tool further provide advantages in allowing the actuation of the tool multiple times to form a crimp. It should be appreciated that while embodiments herein may describe the tool in reference to a particular type of object such as a clamp, this is for example purposes and the claims should not be so limited. In other embodiments, the tool may be used in any application where a manually operated tool having jaws may be used and a repeated actuation of the handles is desired.

Figure 1:
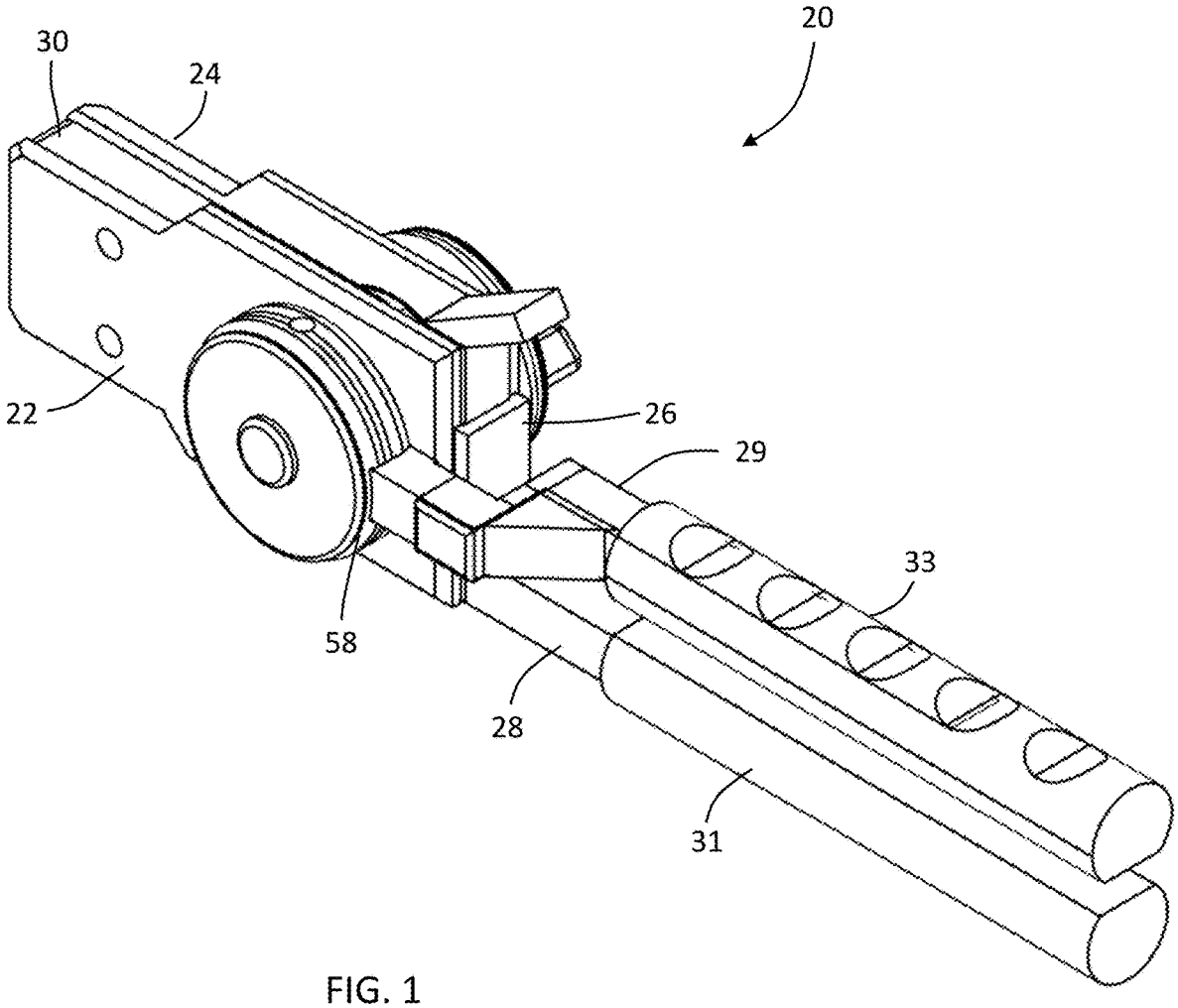
FIG. 1 and FIG. 2 are perspective views of a crimping tool in an open position in accordance with an embodiment.
Figure 2:
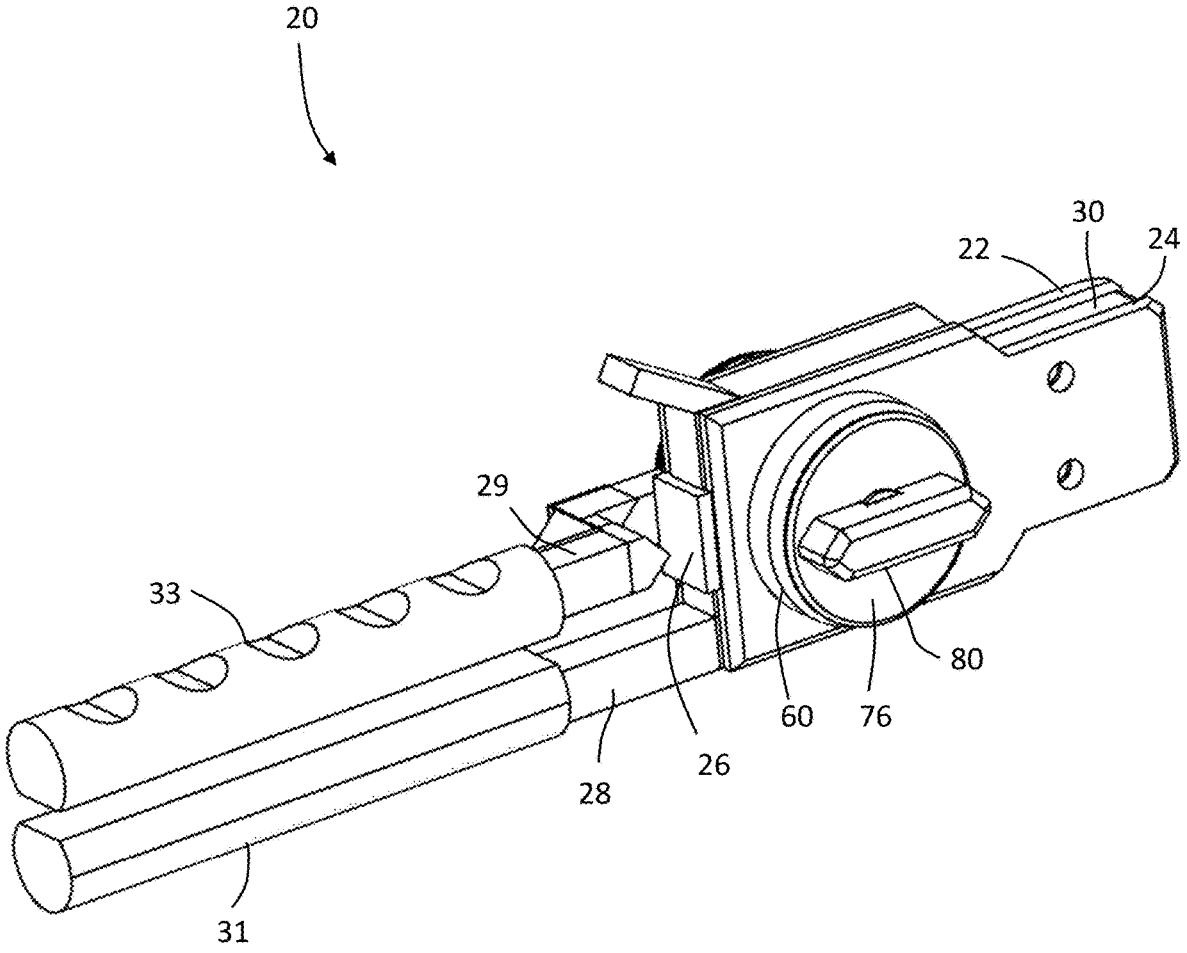
Figure 3:
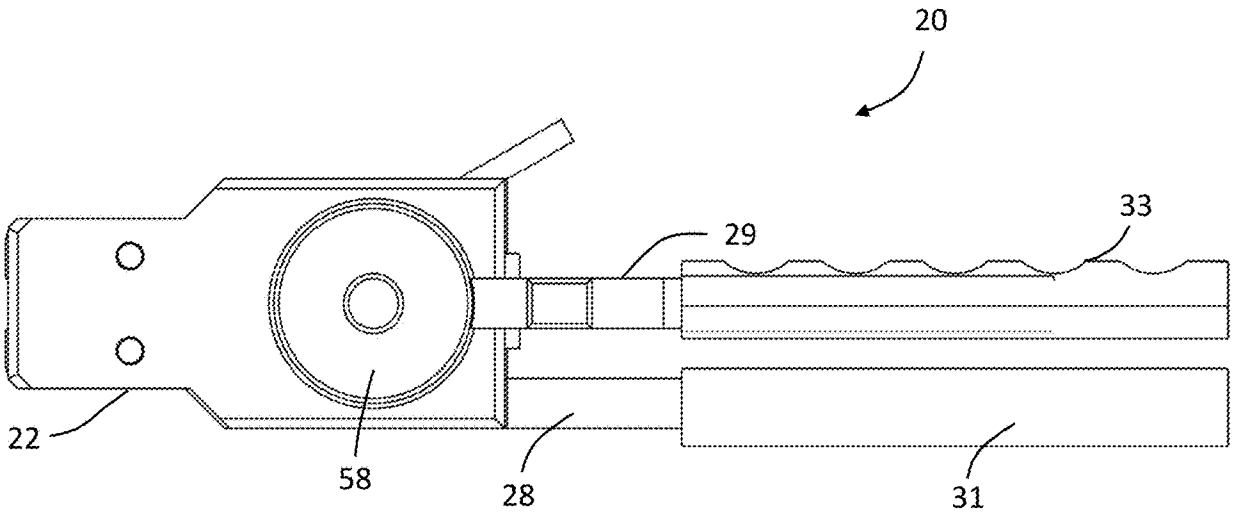
FIG. 3 is a right perspective view of the crimping tool of FIG. 1.
Figure 4:
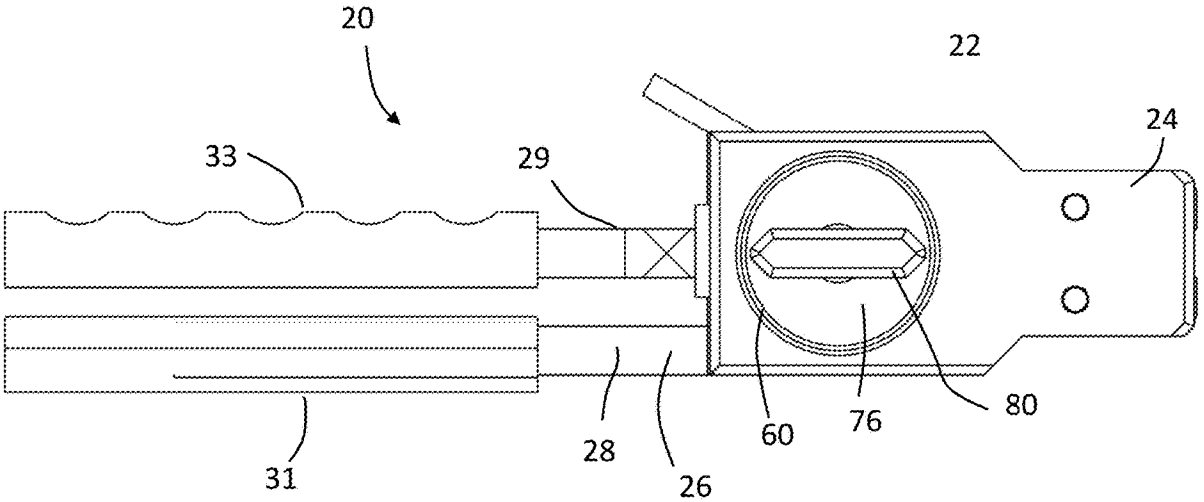
FIG. 4 is a side view of the crimping tool of FIG. 1.
Figure 5:
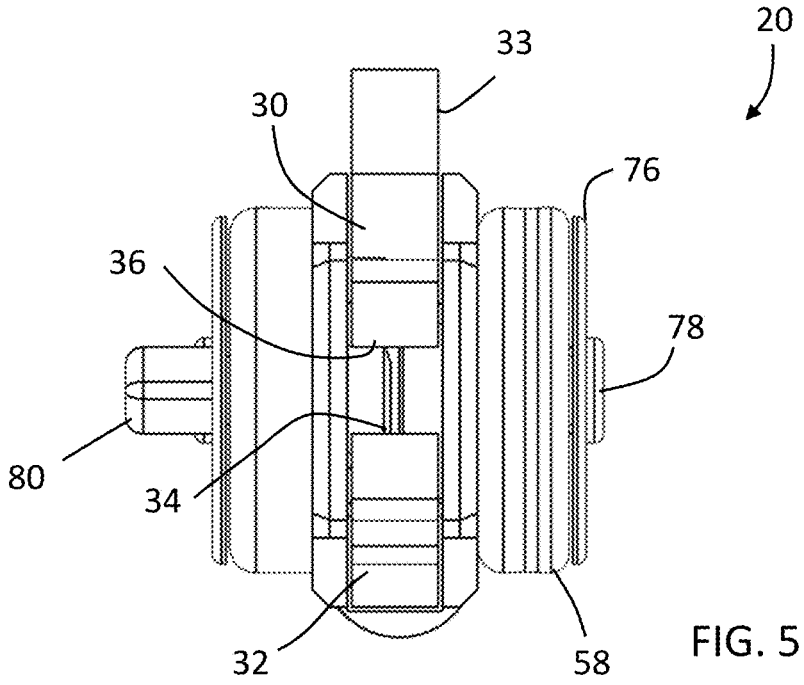
FIG. 5 is a front view of the crimping tool of FIG. 1.
Figure 6:
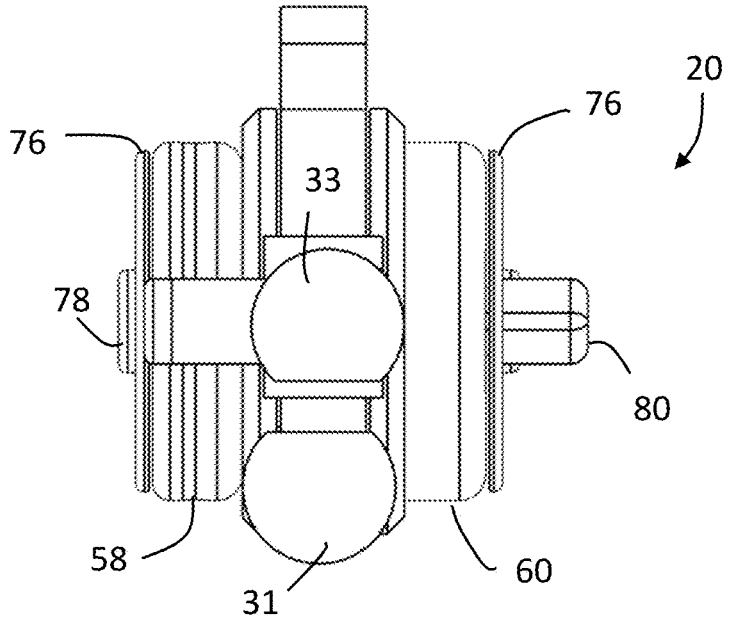
FIG. 6 is a rear view of the crimping tool of FIG. 1.
Figure 7:
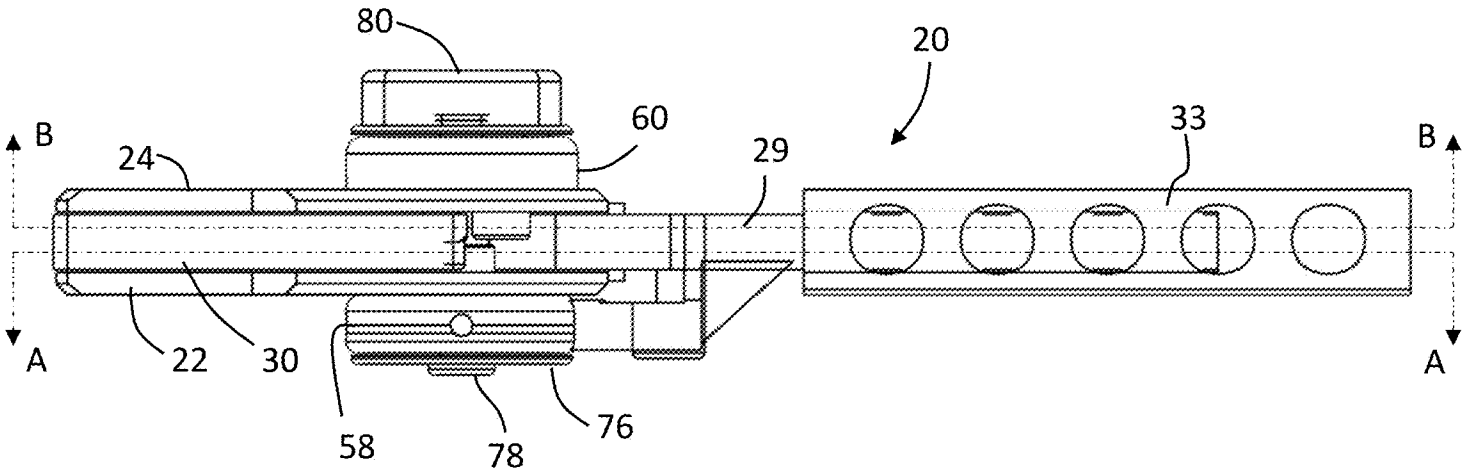
FIG. 7 is a top view of the crimping tool of FIG. 1.
Figure 8:
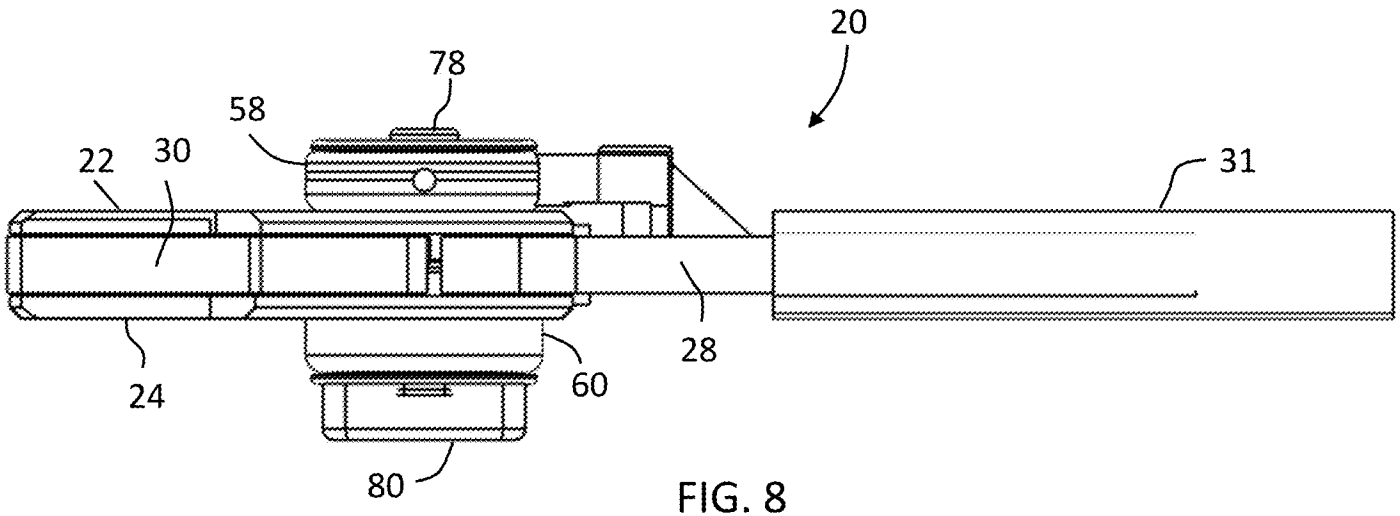
FIG. 8 is a bottom view of the crimping tool of FIG. 1.
Figure 9:
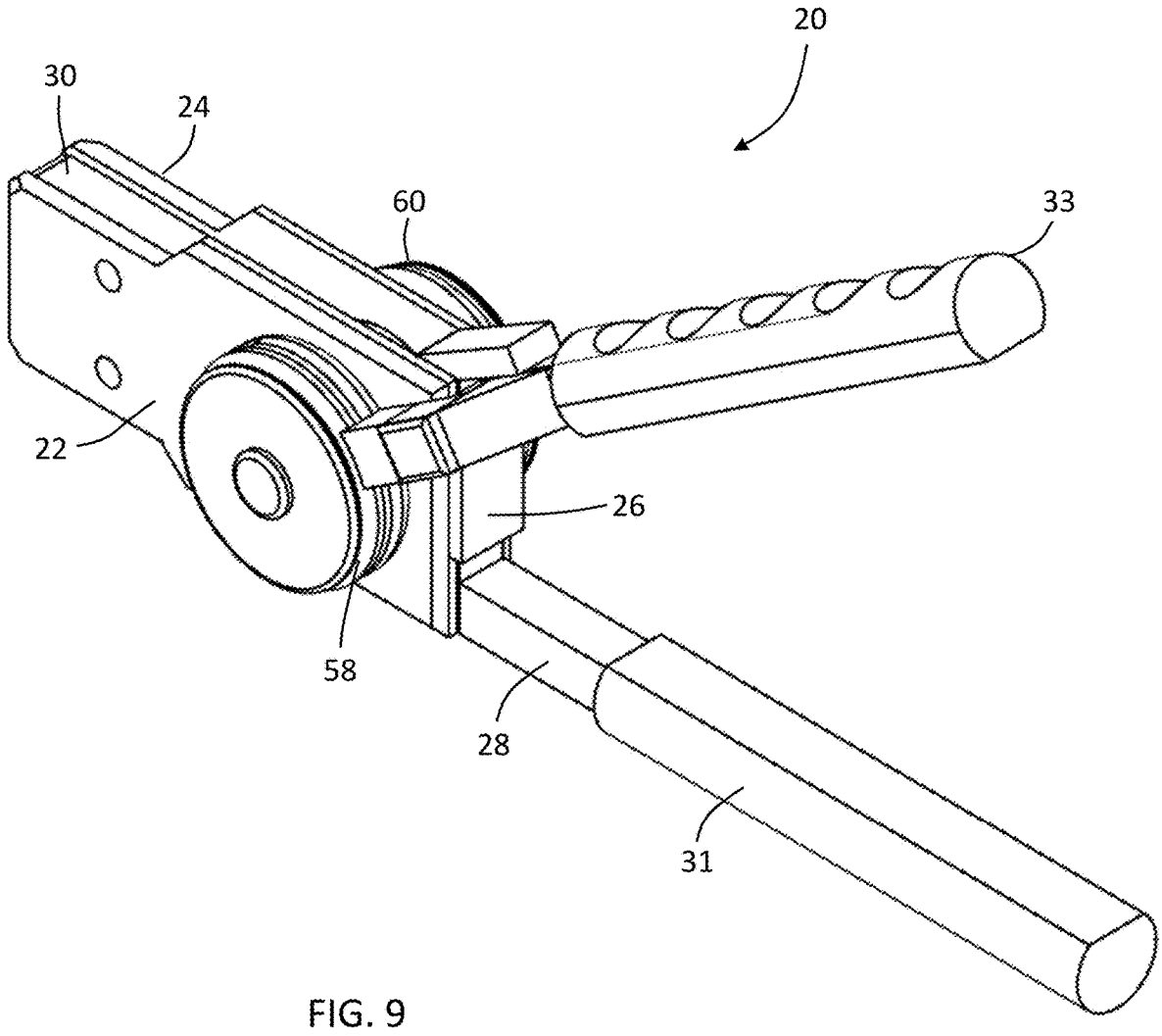
FIG. 9 is a perspective view of the crimping tool of FIG. 1 in a closed or crimped position.
Figure 10:
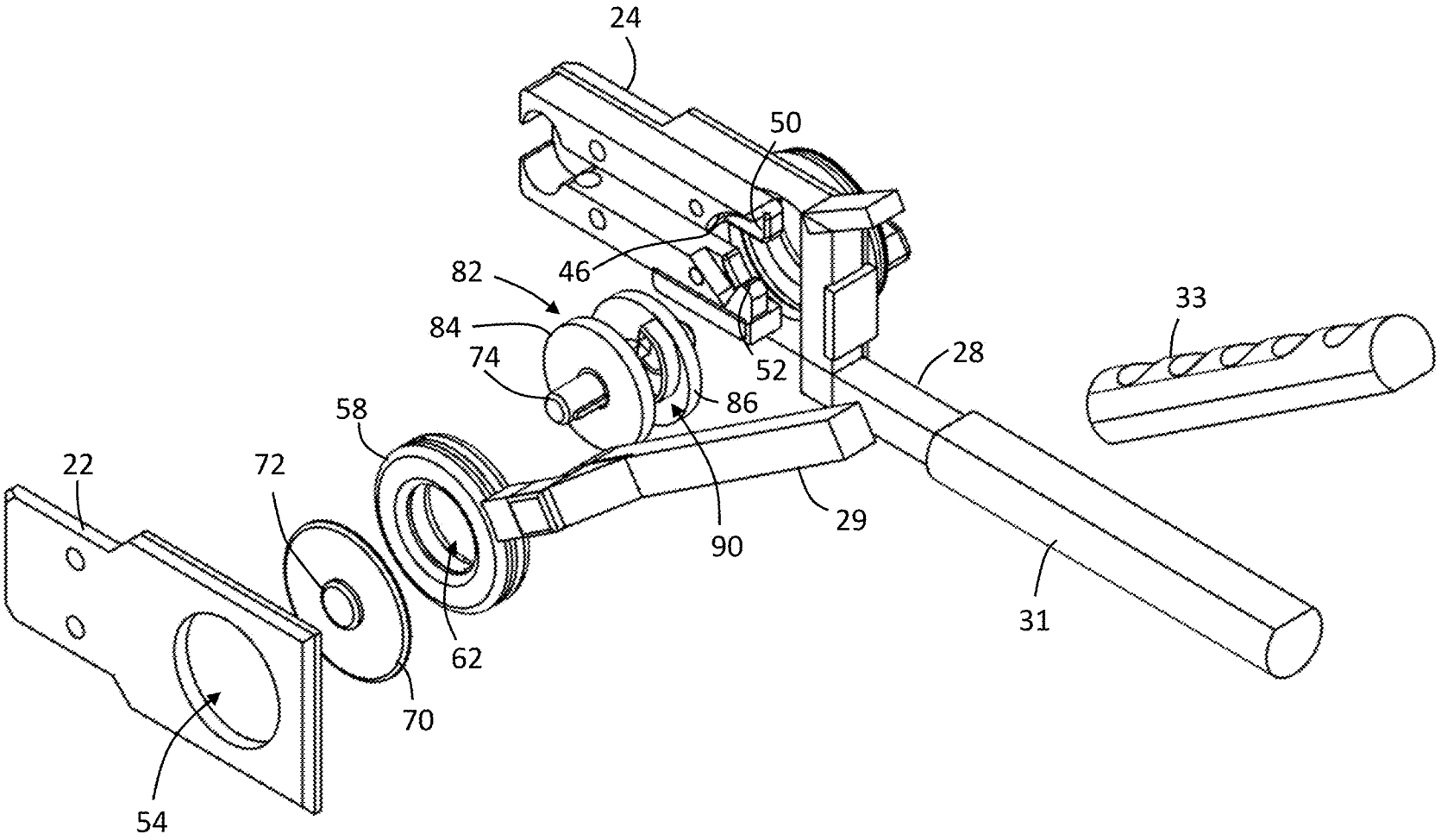
FIG. 10 is a partially unassembled front perspective view of the crimping tool of FIG. 1.
Figure 11:
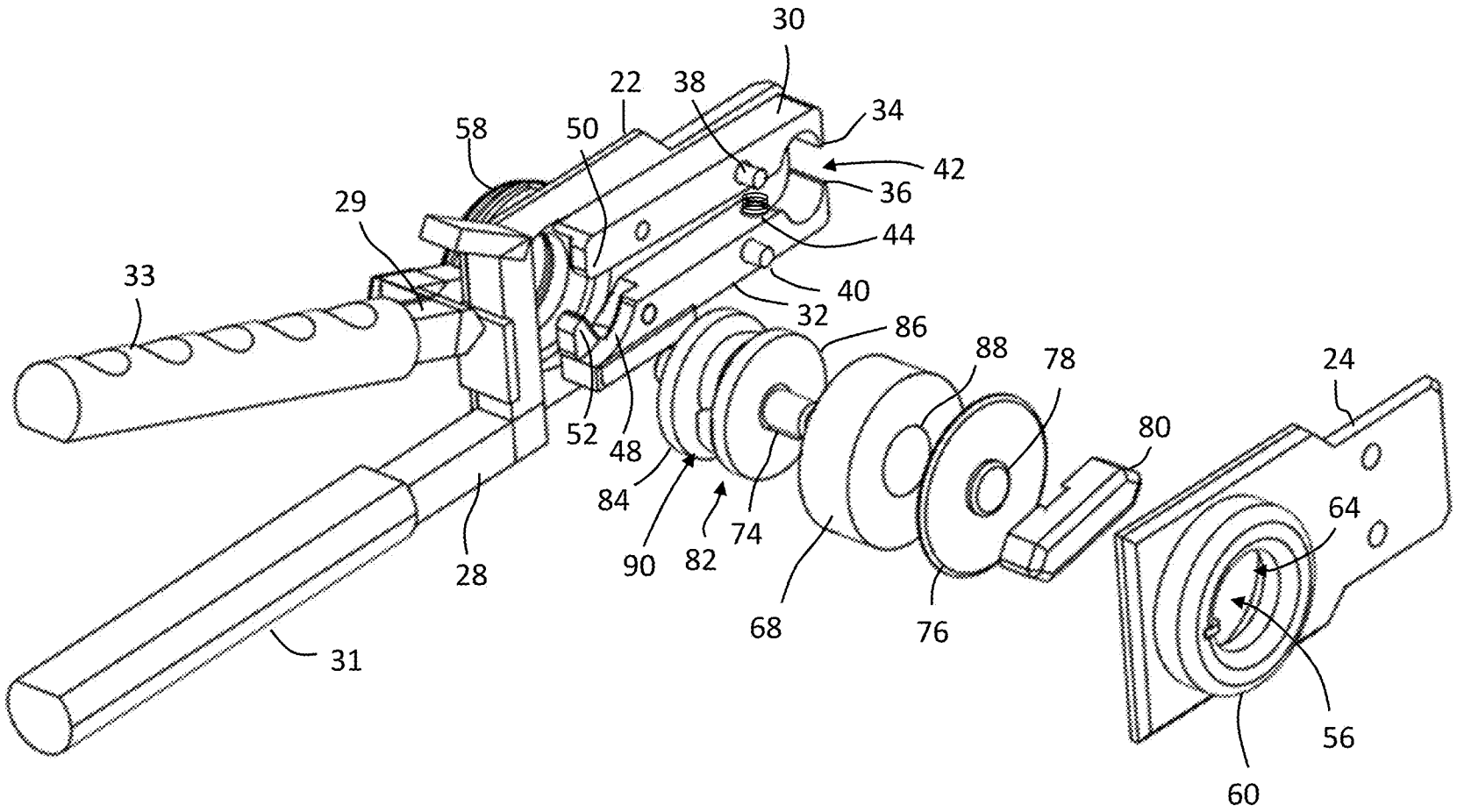
FIG. 11 is a partially unassembled rear perspective view of the crimping tool of FIG. 1.
Figure 12:
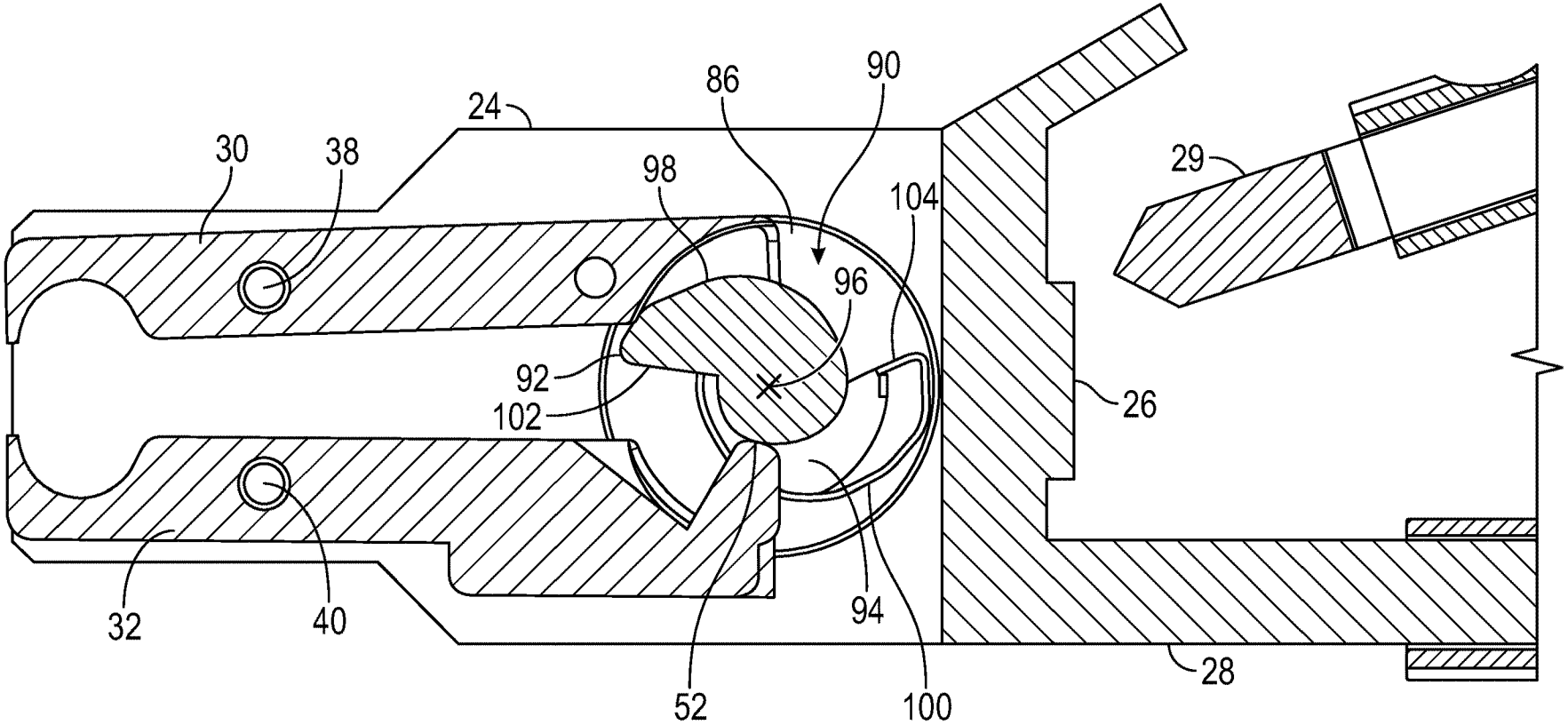
FIG. 12 is a side sectional view along the line A-A of FIG. 7 with the crimping tool in the open position.
Figure 13:
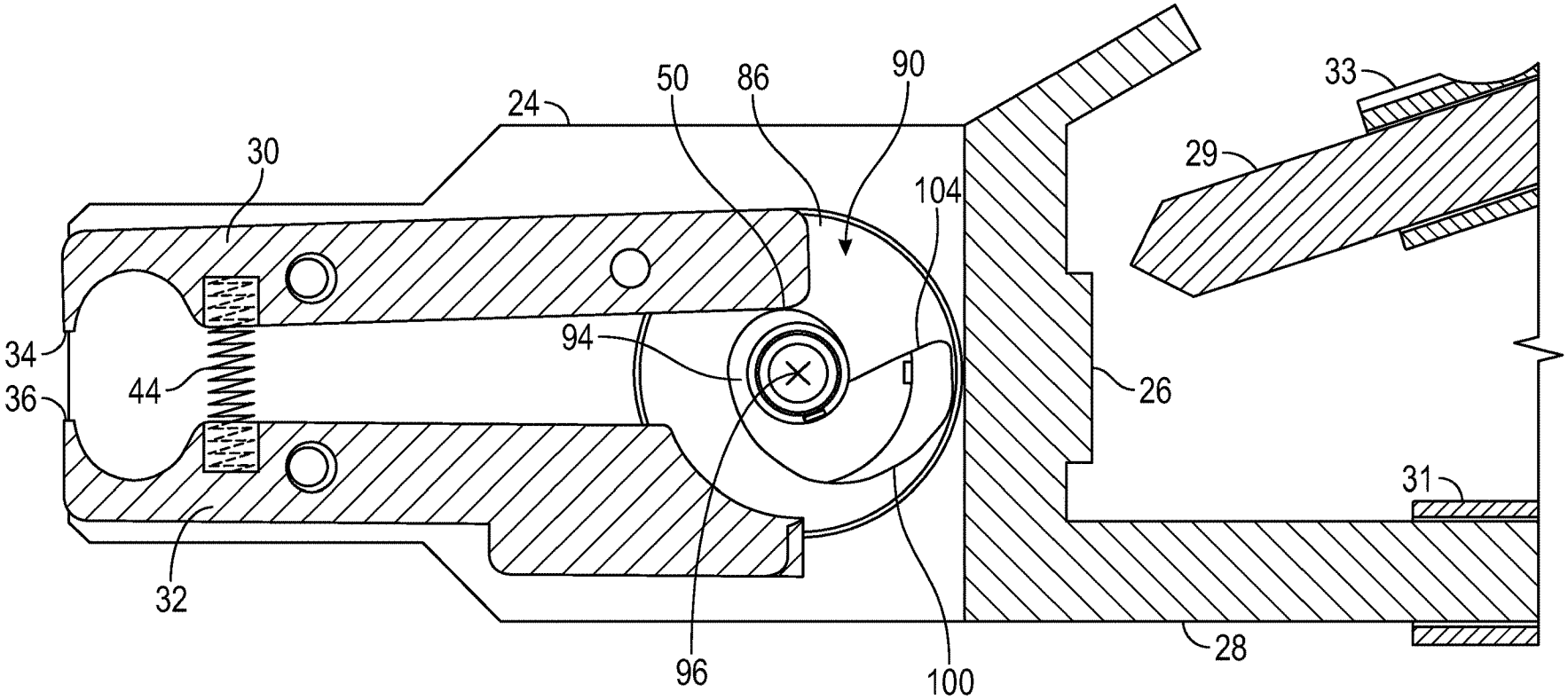
FIG. 13 is a side sectional view along the line B-B of FIG. 7 with the crimping tool the open position.
Figure 14:
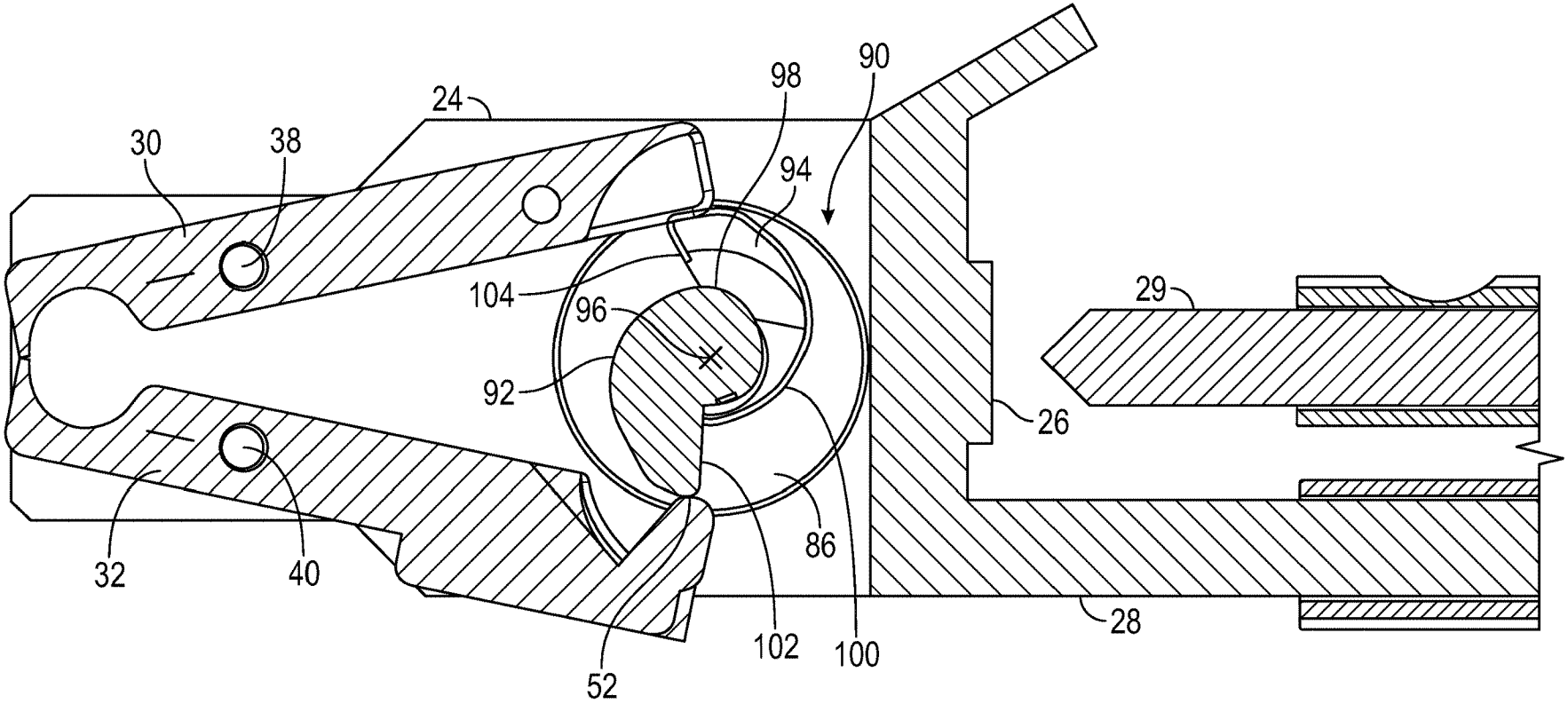
FIG. 14 is a side sectional view along the line A-A of FIG. 7 with the crimping tool in the closed or crimp position.
Figure 15:
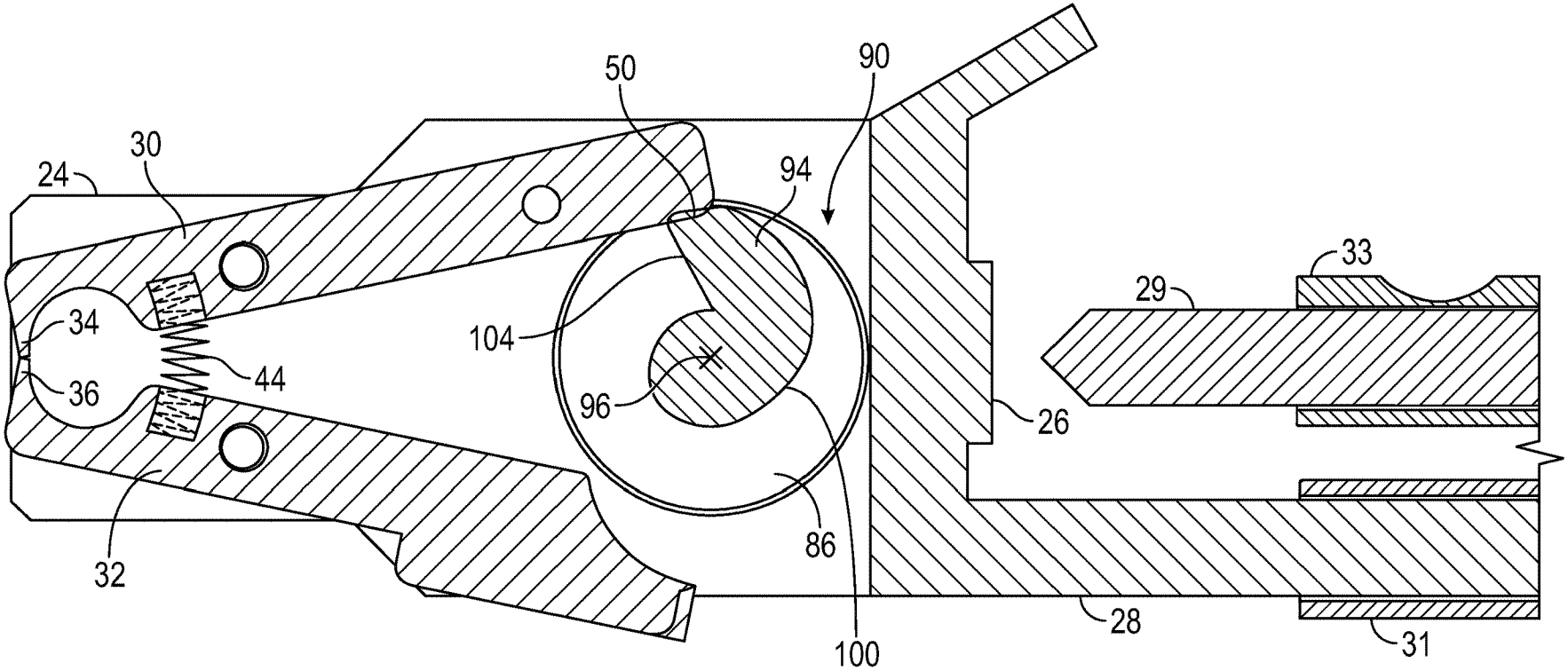
FIG. 15 is a side sectional view along the line B-B of FIG. 7 with the crimping tool the closed or crimp position.

Referring now to FIGS. 1-11, a crimping tool 20 is shown having a first side plate 22 and a second side plate 24 coupled together, at least partially by an intermediate portion 26 of a stationary handle 28. The crimping tool 20 includes a first jaw 30 and a second jaw 32 (FIG. 5). The first jaw 30 and second jaw 32 each have a jaw portion 34, 36 respectively. The jaw portions 34, 36 define an opening 42 when the jaws are in an open position (FIG. 1). In an embodiment, the opening 42 will changing in size between the open position (FIG. 1) and a closed or crimped position (FIG. 15). In this embodiment the opening 42 in the closed position is sized to crimp a band clamp a predetermined amount.

The jaws 30, 32 are rotationally coupled to the side plate 22, 24 to rotate about pivot pins 38, 40 (FIG. 11) respectively. A biasing member, such as compression spring 44, is disposed between the jaws 30, 32 to bias the jaws towards the open position. In an embodiment, the spring 44 is laterally positioned between the pivot pins 38, 40 and the jaw positions 34, 36. Opposite the jaw portions 34, 36, each of the jaws 30, 32 includes a relief area 46, 48 and a follower projection 50, 52 respectively. As will be discussed in more detail herein, the follower projections 50, 52 engage a cam surface to rotate the jaws 30, 32 about the pins 38, 40.

Each of the plates 22, 24 includes an opening 54, 56 respectively. Arranged adjacent each plate 22, 24 and disposed about the openings 54, 56 is a ring member 58, 60 respectively. In the illustrated embodiment, the ring member 60 is fixed to the side plate 24 and the ring member 58 rotates relative to the side plate 22. Each of the ring members 58, 60 includes an opening 62, 64 extending therethrough. The openings 62, 64 are arranged co-axial with the openings 54, 56. In an embodiment, the ring member 60 includes a keyway 66 that extends into the opening 64. As will be discussed in more detail, the keyway 66 engages a sprag clutch 68 to prevent rotation of the outer diameter of the clutch. The opening 62 is enclosed by a cap member 70. The cap member 70 includes a projection 72 having an opening on a side facing the plate 22 that is sized to receive and couple to an end of shaft 74. The opening 64 is similarly enclosed by a cap 76 having a projection 78. The projection 78 includes an opening on a side facing the plate 24 that is sized to receive and couple to an end of the shaft 74. Coupled to the cap 76 is a handle 80 that is disposed about the projection 78. As will be discussed in more detail, the handle may be used to rotate the shaft 74 to change the position of the jaws 30, 32.

Coupled to the ring member 58 is a movable handle 29 that allows the operator to rotate the ring member 58 about an axis defined by the shaft 74 by squeezing the handles 28, 29 together. In an embodiment, each of the handles 28, 29 includes a grip member 31, 33. As will be discussed in more detail, by squeezing or pumping the handles 28, 29 multiple times, the first jaw and second jaw may be moved from the open position to the closed position.

Disposed between the caps 70, 76 is a cam assembly 82. The cam assembly 82 includes and rotates about the shaft 74. In an embodiment, the cam assembly 82 includes a pair of opposing disks 84, 86 that are generally disposed in the openings 54, 56 on either side of the jaws 30, 32. In an embodiment, the sprag clutch 68 is disposed between the disk 86 and the cap 76. The sprag clutch 68 includes an inner diameter 88 that is coupled to the shaft 74. In an embodiment, the sprag clutch 68 is a one-way or one-directional freewheel clutch. The clutch is configured to freely rotate in one direction (e.g. transmit torque to the shaft 74) and prevent rotation in an opposite direction. In the illustrated embodiment, the sprag clutch 68 provides a continuous or stepless (e.g. no teeth) free rotational movement. The use of a sprag clutch 68 provides the technical effect of allowing a continuous/smooth movement of the jaws 30, 32 rather than a discrete incremental steps as occurs in mechanisms that include gears. This stepless closure provided by the sprag clutch provides further technical effect of closing the jaws 30, 32 without backlash between the squeezing or pumping of the handles. For example, in a conventional ratchet mechanism, the jaws could close 1 mm and then move/spring back 0.5 mm. In some embodiments, such as where the tool 20 is used with ear-clamps, this repeated flexing could cause work hardening and potentially premature failure in use.

Disposed between the disks 84, 86 are cam surfaces 90. As best seen in FIGS. 12-16, with continuing reference to FIGS. 1-11, in an embodiment the cam surfaces 90 includes a first cam member 92 and a second cam member 94. The cam members 92, 94 are arranged to rotate about the axis 96 of the shaft 74. In an embodiment, the first cam member 92 extends from, and is integrally formed in, the disk 84. In an embodiment, the second cam member 94 extends from and is integrally formed in, the second disk 86. In an embodiment, the shaft 74 is formed from two shafts that extend from, and are integrally formed in, the disks 84, 86, wherein the two shafts define the axis of rotation 96. In another embodiment, the shaft 74 is a single shaft that extends through the assembly 90.

In the illustrated embodiment, the first cam member 92 and the second cam member 94 have an identical shape and are arranged as mirror images and are rotationally offset from each other. Each cam member includes a cam surface 98, 100 and a reset surface 102, 104 respectively. The reset surfaces 102, 104 extend between a first or starting end and a second or finishing end of the respective cam surfaces 98, 100. In an embodiment the cam surfaces 98, 100 have a variable radius relative to the axis 96. In an embodiment the radius of the cam surfaces relative to the axis 96 continuously varies along its length. The cam surfaces 98, 100 are sized and positioned to engage the follower surfaces 52, 50 respectively. Thus, as the cam surfaces 98, 100 are rotated, such as by movement of the handle 29 for example, the jaws 30, 32 will rotate about the pins 38, 40. In an embodiment, the spring 44 biases the jaws 30, 32 to keep the follower surfaces 52, 50 in contact with the cam surfaces 98 100.

In an embodiment, the cam surfaces 98, 100 are shaped to cause the jaws 30, 32 to move from an open position (FIG. 12, FIG. 13) to a closed position (FIG. 14, FIG. 15) as the cam members 92, 94 are rotated. In an embodiment, when the jaws 30, 32 are in a closed position, the gap 42 will have a predetermined size to provide a desired level of crimp. It should be appreciated that the sprag clutch 68 is configured to allow the rotation of the cam members 92, 94 in a clockwise direction when viewed from the position of FIG. 12. It should be appreciated that the sprag-clutch 68 prevents rotation in the opposite direction.

Figure 16:
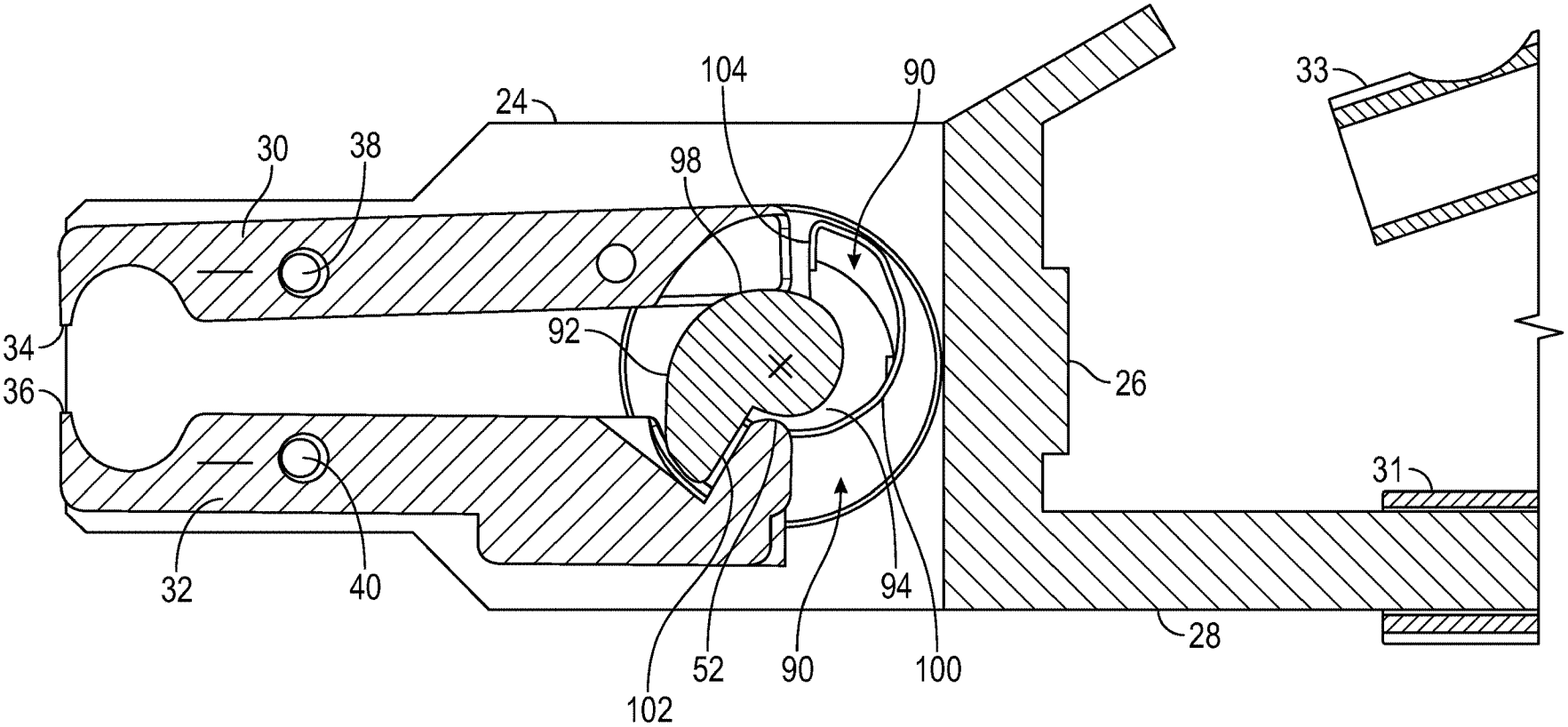
FIG. 16 is a side sectional view along the line A-A of FIG. 7 with the crimping tool in the reset position.
Figure 17:
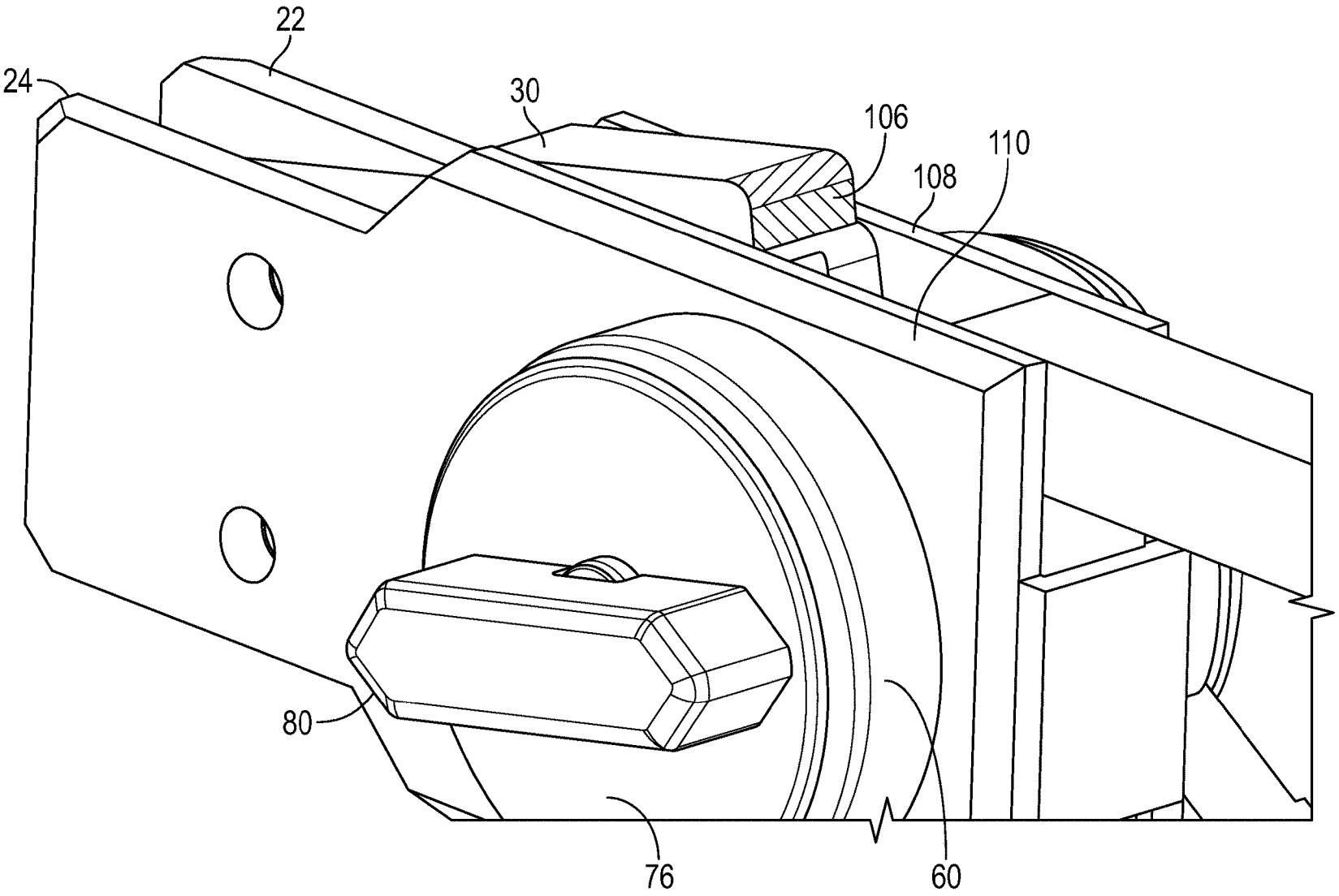
FIG. 17 is a partial perspective view of a crimping tool in a closed position and having a closed indicator in accordance with another embodiment.

Once the jaws 30, 32 have been closed (FIG. 14, FIG. 15), additional movement or pumping of the handles 28, 29 will cause the follower surfaces 52, 50 to move along the reset surfaces 102, 104 and back into contact with the starting end of the cam surfaces 98, 100 as shown in FIG. 16 and FIG. 17. This in turn causes the jaws 30, 32 to return to the open position. With the jaws 30, 32 back in the open position, the operator can remove the tool 20 from the clamp being crimped.

It should be appreciated that the tool 20 may be used with a variety of different size objects (e.g. ear clamps). As a result the distance between the jaw portions 34, 36 and the object (e.g. the ear of an ear clamp) within the gap 42 may vary. When a small clamp is being crimped, the handles 28, 29 may need to be squeezed/pumped many times before the jaw portions 34, 36 engage the clamp. In some embodiments, the size of the gap 42 may be adjusted prior to movement of the handles 28, 29 by rotating the cam handle 80. It should be appreciated that since the cam handle 80 is fixedly coupled to the cap 76 and thus the shaft 74, the rotation of the cam handle 80 will cause the cam members 92, 94 to rotate from the reset position of FIG. 16 and FIG. 17 to a desired intermediate position to reduce the number of times the handles 28, 29 are squeezed before the jaw portions 34, 36 engage the clamp.

Referring now to FIG. 17, an embodiment is shown of a tool 20 provides feedback to the operator on the position of the jaws and whether the crimp is completed. In this embodiment, the jaws 30, 32 include an indicator surface 106 arranged on an end of the jaws 30, 32 opposite the jaw portions 34, 36. In an embodiment, the indicator surface 106 is arranged to be positioned above the sides 108, 110 of the plates 22, 24. Thus it will be visible to an operator. In an embodiment, the indicator surface 106 is configured to move above the sides 108, 110 in response to a desired level of crimp being achieved. In other words, the indicator surface 106 will provide a visual indication to the operator that the crimp is complete.

It should be appreciated that while embodiments herein refer to the use of a tool 20 with a particular type of clamp (e.g. a ear type band clamp), this is for exemplary purposes and the claims should not be so limited. In other embodiments, the tool 20 may be used with other types of clamps or for crimping other types of objects (e.g. sheet metal ductwork). In still other embodiments, the tool 20 may be adapted to perform a cutting operation or be used in cooperation with ring clamps.

Technical effects and benefits of some embodiments include providing a tool that allows the crimping in a continuous motion. Further technical benefits include a crimping mechanism that provides a mechanism for advancing or moving the jaws without having to squeeze or pump the handles. Still a further technical benefit includes a means for providing the operator a visual indication that the crimp is completed.

The term "about" is intended to include the degree of error associated with measurement of the particular quantity based upon the equipment available at the time of filing the application. The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the disclosure is provided in detail in connection with only a limited number of embodiments, it should be readily understood that the disclosure is not limited to such disclosed embodiments. Rather, the disclosure can be modified to incorporate any number of variations, alterations, substitutions or equivalent arrangements not heretofore described, but which are commensurate with the spirit and scope of the disclosure. Additionally, while various embodiments of the disclosure have been described, it is to be understood that the exemplary embodiment(s) may include only some of the described exemplary aspects. Accordingly, the disclosure is not to be seen as limited by the foregoing description, but is only limited by the scope of the appended claims.

What is claimed is:

1. A tool comprising:

a first jaw, the first jaw arranged to rotate about a first pivot;

a second jaw adjacent the first jaw, the second jaw arranged to rotate about a second pivot;

a first cam member rotatable about an axis, the first cam member being operably coupled to the second jaw;

a second cam member rotatable about the axis, the second cam member being operable coupled to the first jaw;

at least one movable handle operably coupled to the first cam member and the second cam member; and a clutch operably coupled to the first cam member and the second cam member, the clutch being configured to allow continuous and stepless free-rotation in first direction about the axis and prevent rotation in an opposite second direction.

2. The tool of claim 1, wherein:

the first jaw includes a first follower surface;

the second jaw includes a second follower surface;

the first cam member includes a first cam surface, the first cam surface engaging the second follower surface to rotate the second jaw from an open position to a closed position; and the second cam member includes a second cam surface, the second cam surface engaging the first follower surface to rotate the first jaw from the open position to the close position.

3. The tool of claim 1, further comprising a biasing member coupled between the first jaw and the second jaw, the biasing member biasing the first jaw and the second jaw towards the open position.

4. The tool of claim 3, wherein the biasing member is a compression spring.

5. The tool of claim 1, further comprising a cam handle operably coupled to rotate the first cam member and the second cam member in the first direction to advance the position of the first jaw and second jaw from the open position towards the closed position.

6. The tool of claim 1, wherein the first jaw has a first jaw portion and the second jaw has a second jaw portion, the first jaw portion and second jaw portion cooperating to crimp an object in response to a movement of the at least one movable handle.

7. A tool comprising:

a first jaw, the first jaw arranged to rotate about a first pivot;

a second jaw adjacent the first jaw, the second jaw arranged to rotate about a second pivot;

a first cam member rotatable about an axis, the first cam member being operably coupled to the second jaw;

a second cam member rotatable about the axis, the second cam member being operable coupled to the first jaw;

at least one movable handle operably coupled to the first cam member and the second cam member; and a clutch operably coupled to the first cam member and the second cam member, the clutch being configured to allow free-rotation in first direction about the axis and prevent rotation in an opposite second direction; and wherein the first cam member further includes a first reset surface disposed between a first end and a second end of the first cam surface, the second follower surface moving over the first reset surface to move the second jaw from the closed to the open position in response to further rotation of the first cam member when the jaws are in the closed position; and the second cam member further includes a second reset surface disposed between a first end and a second end of the second cam surface, the first follower surface moving over the second reset surface to move the first jaw from the closed to the open position in response to further rotation of the second cam member when the jaws are in the closed position.

8. A tool comprising:

a first jaw, the first jaw arranged to rotate about a first pivot;

a second jaw adjacent the first jaw, the second jaw arranged to rotate about a second pivot;

a first cam member rotatable about an axis, the first cam member being operably coupled to second jaw;

a second cam member rotatable about the axis, the second cam member being operable coupled to the first jaw;

at least one movable handle operably coupled to the first cam member and the second cam member; and a clutch operably coupled to the first cam member and the second cam member, the clutch being configured to allow free-rotation in first direction about the axis and prevent rotation in an opposite second direction;

wherein the first jaw has a first jaw portion and the second jaw has a second jaw portion, the first jaw portion and second jaw portion cooperating to crimp an object in response to a movement of the at least one movable handle; and wherein the first jaw includes an indicator surface on an end of the of the first jaw opposite the first jaw portion.

9. A tool comprising:

a first jaw arranged to rotate about a first pivot between an open position and a closed position, the first jaw having a first jaw portion on a first end and a first follower on a second end;

a second jaw arranged to rotate about a second pivot between the open position and the closed position, the second jaw having a second jaw portion on a first end a and a second follower on a second end;

a cam assembly arranged to rotate about an axis, the cam assembly being operably coupled to the first follower and the second follower to move the first aw and the second jaw from the open position to the closed position in response to a rotation of the cam assembly; and a clutch operably coupled to the cam assembly to allow continuous and stepless free rotation in a single direction.

10. The tool of claim 9, a first jaw arranged to rotate about a first pivot between an open position and a closed position, the first jaw having a first jaw portion on a first end and a first follower on a second end;

a second jaw arranged to rotate about a second pivot between the open position and the closed position, the second jaw having a second jaw portion on a first end a and a second follower on a second end;

a cam assembly arranged to rotate about an axis, the cam assembly being operably coupled to the first follower and the second follower to move the first aw and the second jaw from the open position to the closed position in response to a rotation of the cam assembly; and a clutch operably coupled to the cam assembly to allow rotation in a single direction;

wherein the cam assembly includes:

a first shaft operably coupled to the clutch;

a first cam member operably coupled between the shaft and the second follower; and a second cam member operably coupled between the shaft and the first follower.

11. The tool of claim 10, further comprising a cam handle operably coupled to the first shaft opposite the cam assembly.

12. The tool of claim 11, further comprising a movable handle operably coupled to the cam assembly; and a stationary handle operably coupled to the first pivot and the second pivot.

13. The tool of claim 12, further comprising a biasing member coupled between the first jaw and the second jaw, the biasing member being disposed between the first pivot and the first jaw portion.

14. The tool of claim 10, wherein the cam assembly further includes a first disk member coupled to the first cam member and a second disk member coupled to the second cam member, the second disk member being arranged between the second cam member and the clutch.

15. The tool of claim 14, wherein the first cam member extends from the first disk member and the second cam member extends from the second disk member.

16. The tool of claim 15, wherein the first cam member is integrally formed with the first disk member and the second cam member is integrally formed with the second disk member.

17. A method of crimping an object, the method comprising:

moving a handle;

rotating a cam assembly in a first direction in response to movement of the handle, the cam assembly having a first cam surface engaged with a first follower of a first jaw and a second cam surface engaged with a second follower of a second jaw;

preventing rotation in a second direction with a clutch, the clutch being operably coupled to the cam assembly, the second direction being opposite the first direction, wherein the clutch is configured to allow continuous and stepless free rotation in the first direction; and rotating the first jaw and the second jaw from an open position to a closed position to crimp the object in response to rotation of the cam assembly.

18. The method of claim 17, further comprising advancing the movement of the first jaw and the second jaw from the open position to the closed position in response to movement of a cam handle, the cam handle being operably coupled to the cam assembly.

19. The method of claim 17, further comprising moving a handle;

rotating a cam assembly in a first direction in response to movement of the handle, the cam assembly having a first cam surface engaged with a first follower of a first jaw and a second cam surface engaged with a second follower of a second jaw;

preventing rotation in a second direction with a clutch, the clutch being operably coupled to the cam assembly, the second direction being opposite the first direction;

rotating the first jaw and the second jaw from an open position to a closed position to crimp the object in response to rotation of the cam assembly; and displaying an indicating surface when the first jaw and the second jaw are in the closed position, the indicating surface being disposed on an end of the one of the first jaw and the second jaw.

20. The method of claim 17, further comprising moving the first jaw and the second jaw from the closed position to the open position in response to further movement of the handle after the first jaw and the second jaw are in the closed position.

* * * * *